US012004674B2

(12) United States Patent
Toliver

(10) Patent No.: US 12,004,674 B2
(45) Date of Patent: Jun. 11, 2024

(54) NECK PILLOW BLADDER ASSEMBLY

(71) Applicant: Darwin Toliver, Cincinnati, OH (US)

(72) Inventor: Darwin Toliver, Cincinnati, OH (US)

( * ) Notice: Subject to any disclaimer, the term of this patent is extended or adjusted under 35 U.S.C. 154(b) by 558 days.

(21) Appl. No.: 17/241,565

(22) Filed: Apr. 27, 2021

(65) Prior Publication Data

US 2022/0338650 A1 Oct. 27, 2022

(51) Int. Cl.
*A47G 9/10* (2006.01)
*A45F 3/20* (2006.01)
*A45F 3/00* (2006.01)

(52) U.S. Cl.
CPC ..... *A47G 9/1045* (2013.01); *A45F 3/20* (2013.01); *A47G 9/1081* (2013.01); *A45F 2003/003* (2013.01)

(58) Field of Classification Search
CPC ..... A47G 9/10; A47G 9/1072; A47G 9/1081; A47G 9/109; A45F 3/20; A45F 2003/003; A45F 2003/166
See application file for complete search history.

(56) References Cited

U.S. PATENT DOCUMENTS 3,312,987 A * 4/1967 Emery ..... A47G 9/10 5/636
6,644,475 B2 11/2003 Wilson, II
6,941,601 B2 9/2005 DeBartolo
7,146,663 B2 * 12/2006 Brown ..... A47D 13/083 5/636
8,141,728 B1 * 3/2012 Dahler ..... A61J 9/006 215/11.4
9,009,867 B2 4/2015 Bowen
D852,542 S 7/2019 Sellmeyer
10,561,259 B1 2/2020 Gaspari
10,709,184 B2 * 7/2020 Moore ..... A41D 23/00
2002/0124317 A1 9/2002 Schupp
2002/0166173 A1 * 11/2002 Brown ..... A47G 11/001 5/639
2005/0082316 A1 * 4/2005 Betkowski ..... A47C 7/72 222/192
2008/0172792 A1 7/2008 Dreessen
2017/0202376 A1 * 7/2017 Isis ..... A47C 7/383
2017/0233240 A1 * 8/2017 Bouzis ..... A47G 9/1045 222/131

* cited by examiner

*Primary Examiner* — Fredrick C Conley

(57) ABSTRACT

A neck pillow bladder assembly includes a neck pillow that is curved into a U-shape for positioning around a user's neck. A compartment is integrated into the neck pillow and a bladder is insertable into the compartment in the neck pillow. The bladder can be filled with a fluid beverage and a tube is fluidly attachable to the bladder to receive the fluid beverage. Additionally, the tube is exposed when the bladder is positioned in the compartment to facilitate a user to drink the liquid beverage from the tube. A mouthpiece is fluidly coupled to the tube for positioning in the user's mouth to facilitate the user to drink the liquid beverage from the mouthpiece.

8 Claims, 8 Drawing Sheets

NECK PILLOW BLADDER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

The Names of the Parties to a Joint Research Agreement

Not Applicable

Incorporation-by-Reference of Material Submitted on a Compact Disc or as a Text File Via the Office Electronic Filing System Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to bladder devices and more particularly pertains to a new bladder device for storing a beverage in a bladder that can be worn around a user's neck. The device includes a neck pillow that has a compartment integrated therein which can insertably receive the bladder. Additionally, the drinking tube is integrated into the bladder to facilitate the user to drink the beverage when the neck pillow is positioned around the user's neck.

(2) Description of Related Art Including Information Disclosed Under 37 CFR 1.97 and 1.98

The prior art relates to bladder devices including a variety of pillows that have a fluid reservoir integrated therein to facilitate a user to drink a beverage contained in the fluid reservoir. The prior art also discloses a variety of apparel items that have a fluid reservoir integrated therein to facilitate a person that is wearing the apparel item to consume a beverage in the fluid reservoir. In no instance does the prior art disclose a neck pillow and a bladder that is insertable into the neck pillow to facilitate a user to drink a beverage while the neck pillow is positioned around the user's neck.

BRIEF SUMMARY OF THE INVENTION

An embodiment of the disclosure meets the needs presented above by generally comprising a neck pillow that is curved into a U-shape for positioning around a user's neck. A compartment is integrated into the neck pillow and a bladder is insertable into the compartment in the neck pillow. The bladder can be filled with a fluid beverage and a tube is fluidly attachable to the bladder to receive the fluid beverage. Additionally, the tube is exposed when the bladder is positioned in the compartment to facilitate a user to drink the liquid beverage from the tube. A mouthpiece is fluidly coupled to the tube for positioning in the user's mouth to facilitate the user to drink the liquid beverage from the mouthpiece.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
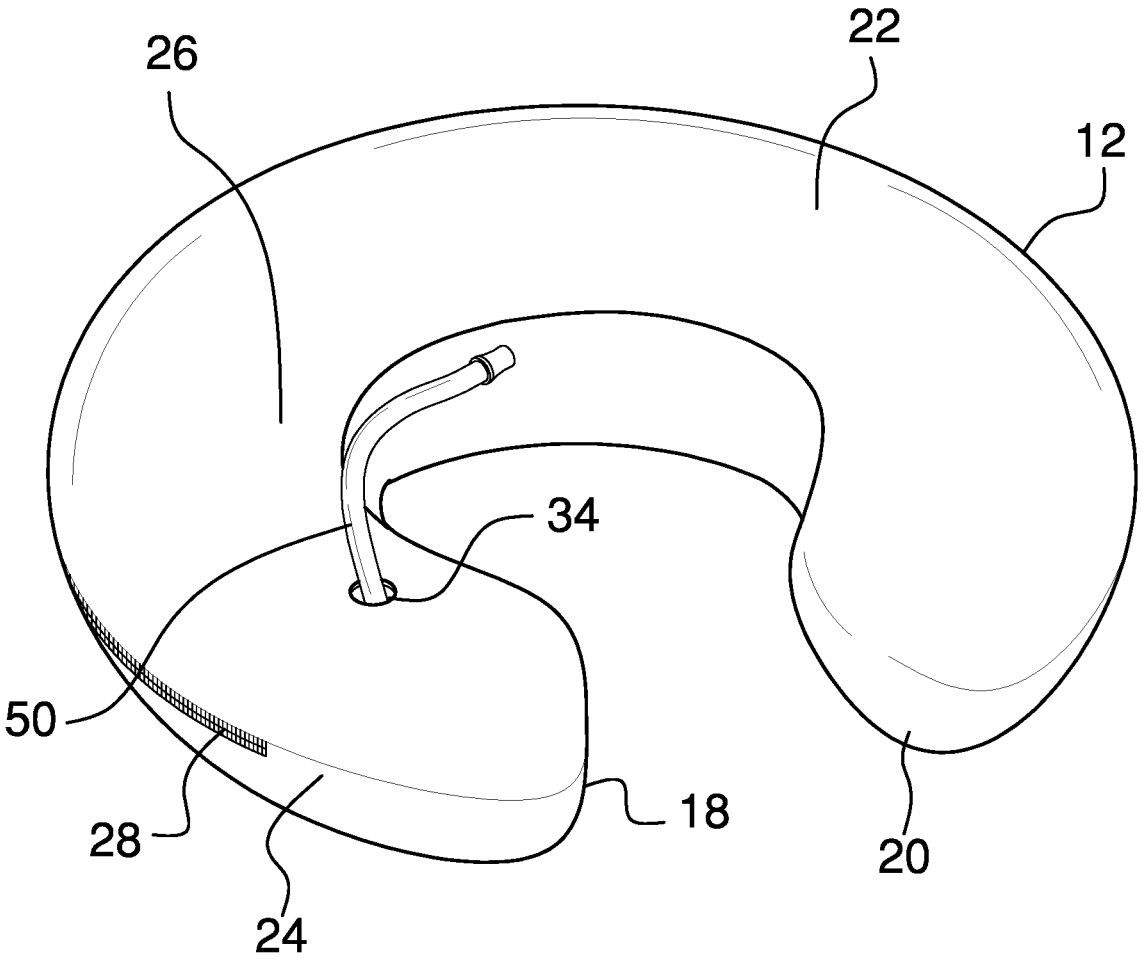
FIG. 1 is a perspective view of a neck pillow bladder assembly according to an embodiment of the disclosure.
Figure 2:
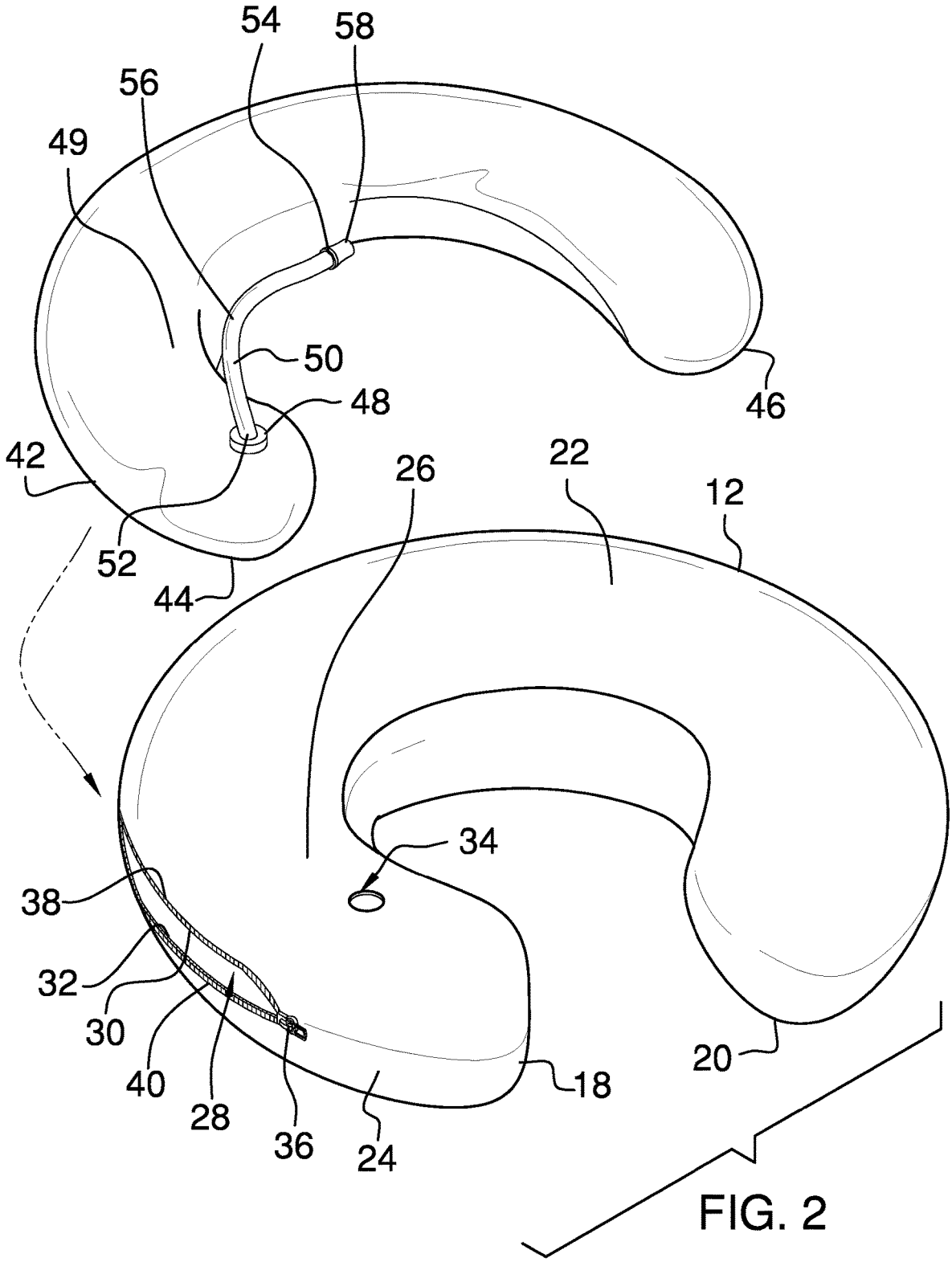
FIG. 2 is an exploded perspective view of an embodiment of the disclosure.
Figure 3:
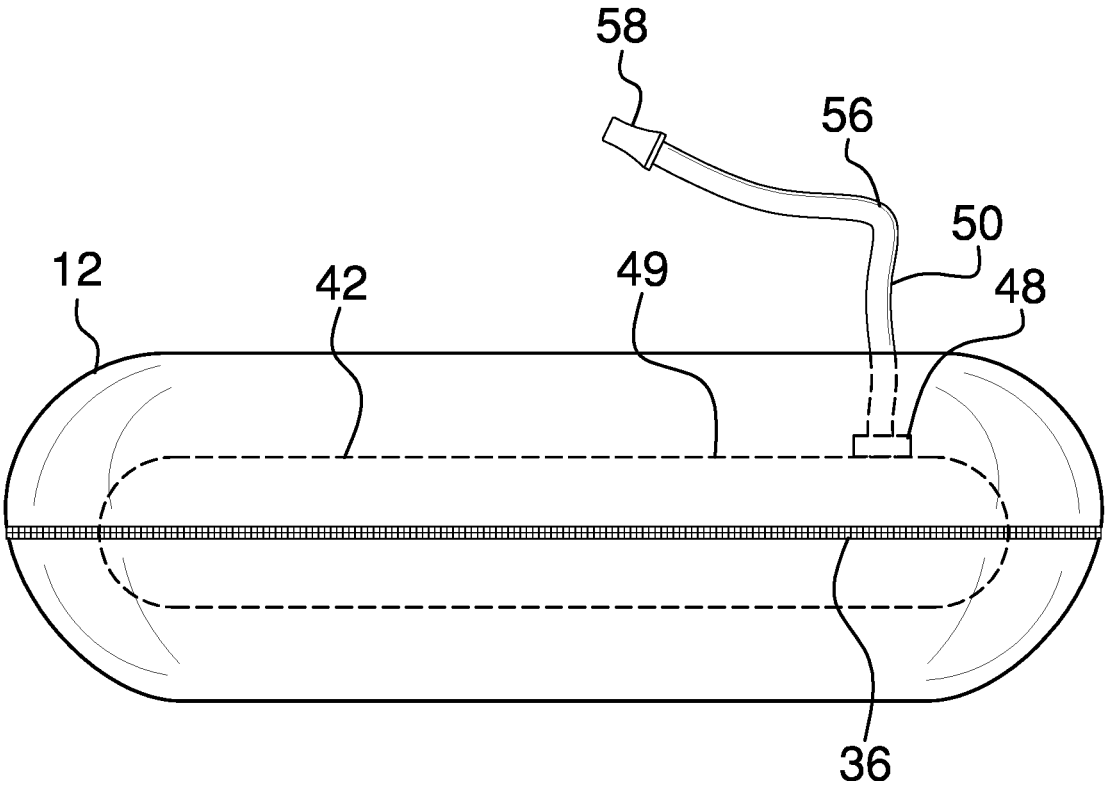
FIG. 3 is a back phantom view of an embodiment of the disclosure.
Figure 4:
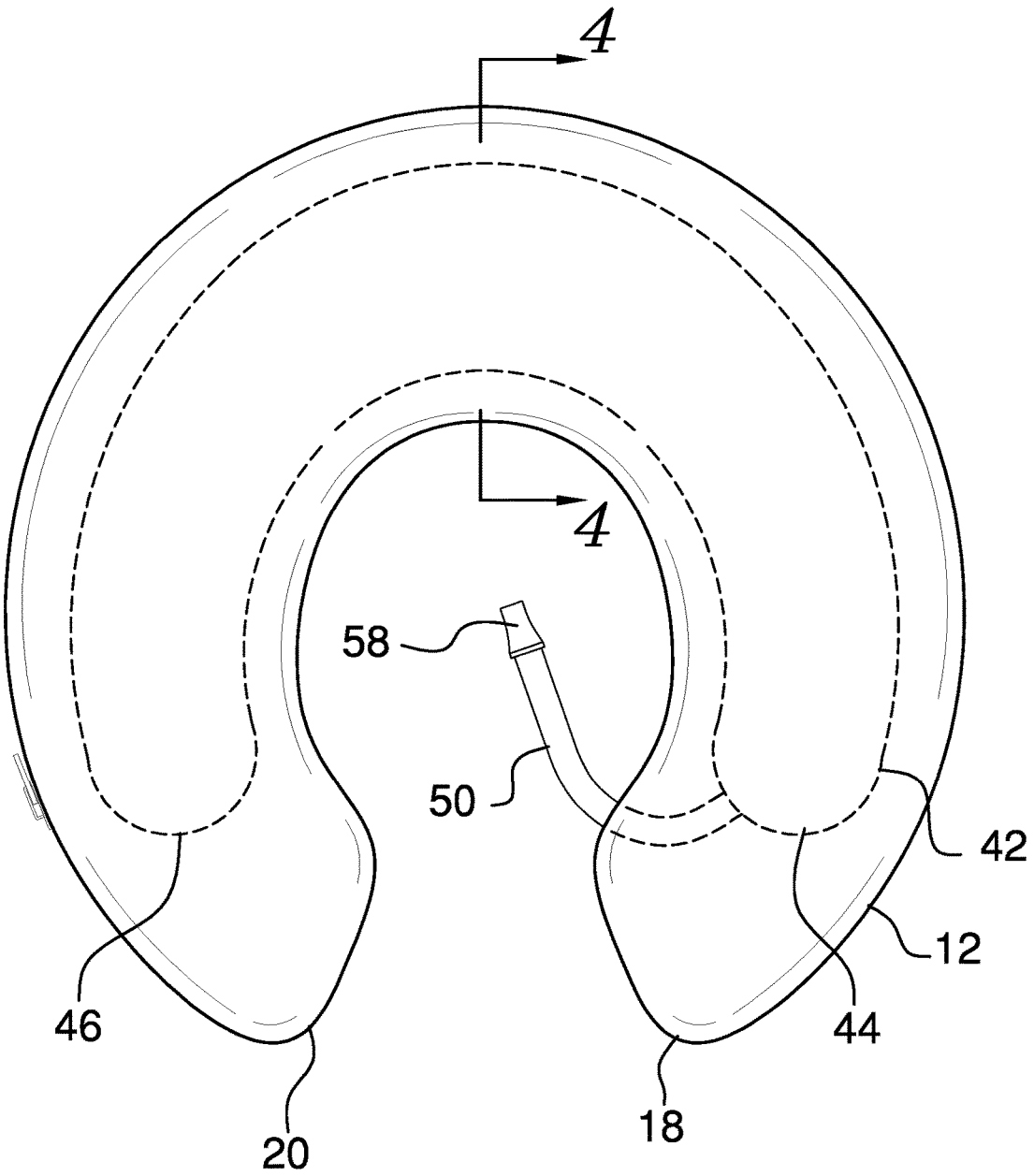
FIG. 4 is a bottom phantom view of an embodiment of the disclosure.
Figure 5:
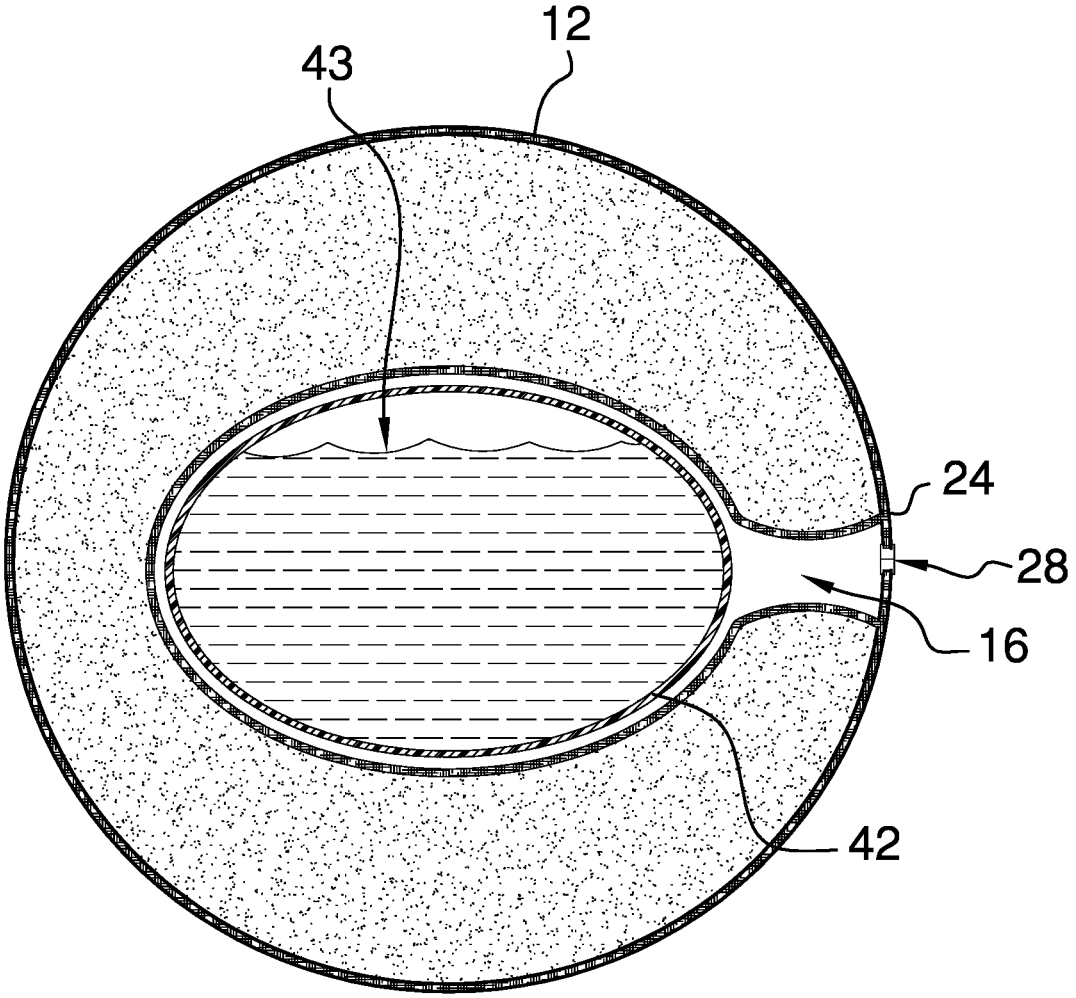
FIG. 5 is a cross sectional view taken along line 5-5 of FIG. 4 of an embodiment of the disclosure.

With reference now to the drawings, and in particular to FIGS. 1 through 8 thereof, a new bladder device embodying the principles and concepts of an embodiment of the disclosure and generally designated by the reference numeral 10 will be described.

As best illustrated in FIGS. 1 through 8, the neck pillow bladder assembly 10 generally comprises a neck pillow 12 that is curved into a U-shape such that the neck pillow 12 can be positioned around a user's neck 14, and a compartment 16 is integrated into the neck pillow 12. The neck pillow 12 has a first end 18, a second end 20 and an outer wall 22 extending therebetween, and the outer wall 22 is continuously arcuate around an axis extending through the first end 18 and the second end 20 such that the neck pillow 12 has a tubular shape. Moreover, the outer wall 22 is curved between the first end 18 and the second end 20 has the first end 18 is spaced from the second end 20.

The outer wall 22 has an outwardly facing side 24 and a top side 26, and the outwardly facing side 24 has a cut 28 extending into the compartment 16. The cut 28 extends substantially between the first end 18 and the second end 20, and the cut 28 has a first bounding edge 30 and a second bounding edge 32. The top side 26 of the outer wall 22 has a tube opening 34 extending into the compartment 16 and the tube opening 34 is positioned adjacent to the first end 18.

A closure 36 is coupled to the neck pillow 12 and the closure 36 includes a first portion 38 that is coextensive with the first bounding edge 30 of the cut 28. The closure 36 includes a second portion 40 that is coextensive with the second bounding edge 32 of the cut 28. Moreover, the first portion 38 releasably engages the second portion 40 for opening or closing the cut 28. The closure 36 may comprise a zipper or other type of releasable mechanical fastener.

A bladder 42 is comprised of a fluid impermeable material such that the bladder 42 can contain a liquid beverage 43, and the bladder 42 is insertable into the compartment 16 in the neck pillow 12. The liquid beverage 43 may be water, juice, soda or any other type of beverage commonly consumed by people. The bladder 42 has a primary end 44 and a secondary end 46, and the bladder 42 is elongated between the primary end 44 and the secondary end 46. The bladder 42 is curved between the primary end 44 and the secondary end 46 such that the bladder 42 conforms to the shape of the neck pillow 12. The bladder 42 has an outlet 48 extends into an interior of the bladder 42 to release the liquid beverage 43 from the bladder 42. The outlet 48 is positioned adjacent to the primary end 44 and the outlet 48 is positioned on an upper side 49 of the bladder 42.

A tube 50 is fluidly attachable to the bladder 42 such that the tube 50 receives the fluid beverage. The tube 50 is exposed when the bladder 42 is positioned in the compartment 16 in the neck pillow 12 such that the tube 50 is accessible to the user for drinking the liquid beverage 43 from the tube 50. The user may be a patient in a hospital or an individual that is bed-ridden. The tube 50 has a lower end 52 and an upper end 54, and the tube 50 has a bend 56 thereon that is positioned between the lower end 52 and the upper end 54. The lower end 52 fluidly engages the outlet 48 in the bladder 42 and the tube 50 extends through the tube opening 34 in the outer wall 22 of the neck pillow 12 when the bladder 42 is inserted into the compartment 16. The upper end 54 is directed toward the second end 20 of the neck pillow 12 when the tube 50 is extended through the tube opening 34. In this way the upper end 54 can be positioned near the user's mouth.

A mouthpiece 58 is fluidly coupled to the tube 50 such that the mouthpiece 58 can be positioned in the user's mouth to facilitate the user to drink the liquid beverage 43 from the mouthpiece 58. The mouthpiece 58 is positioned on the upper end 54 of the tube 50 and the mouthpiece 58 is biased into a closed condition to inhibit the liquid beverage 43 from passing through the mouthpiece 58. The mouthpiece 58 is urgeable into an open condition to pass the liquid beverage 43 through the mouthpiece 58 for drinking. Additionally, the mouthpiece 58 may be a bite valve that would commonly be associated with drinking tubes or other type of fluid valve.

Figure 6:
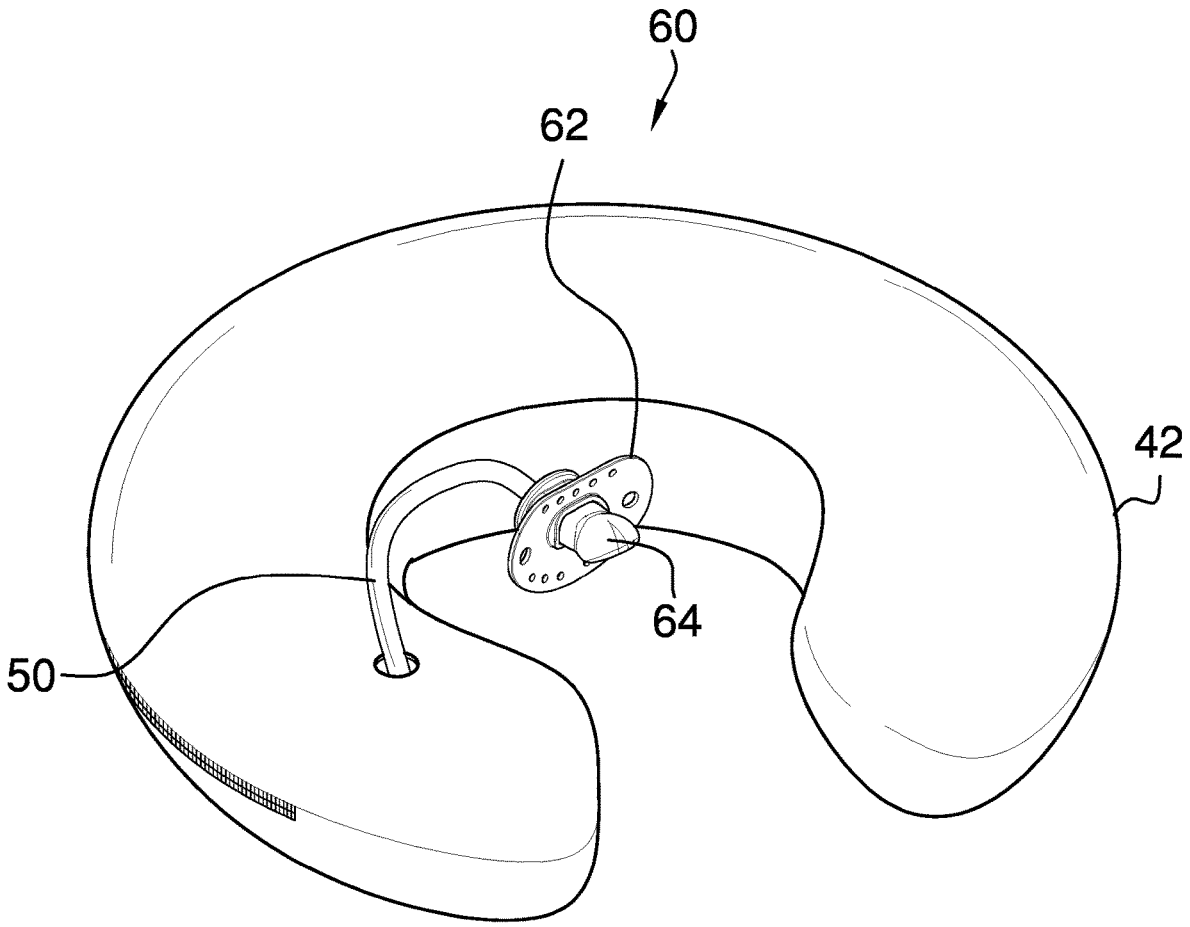
FIG. 6 is a perspective view of an alternative embodiment of the disclosure.
Figure 7:
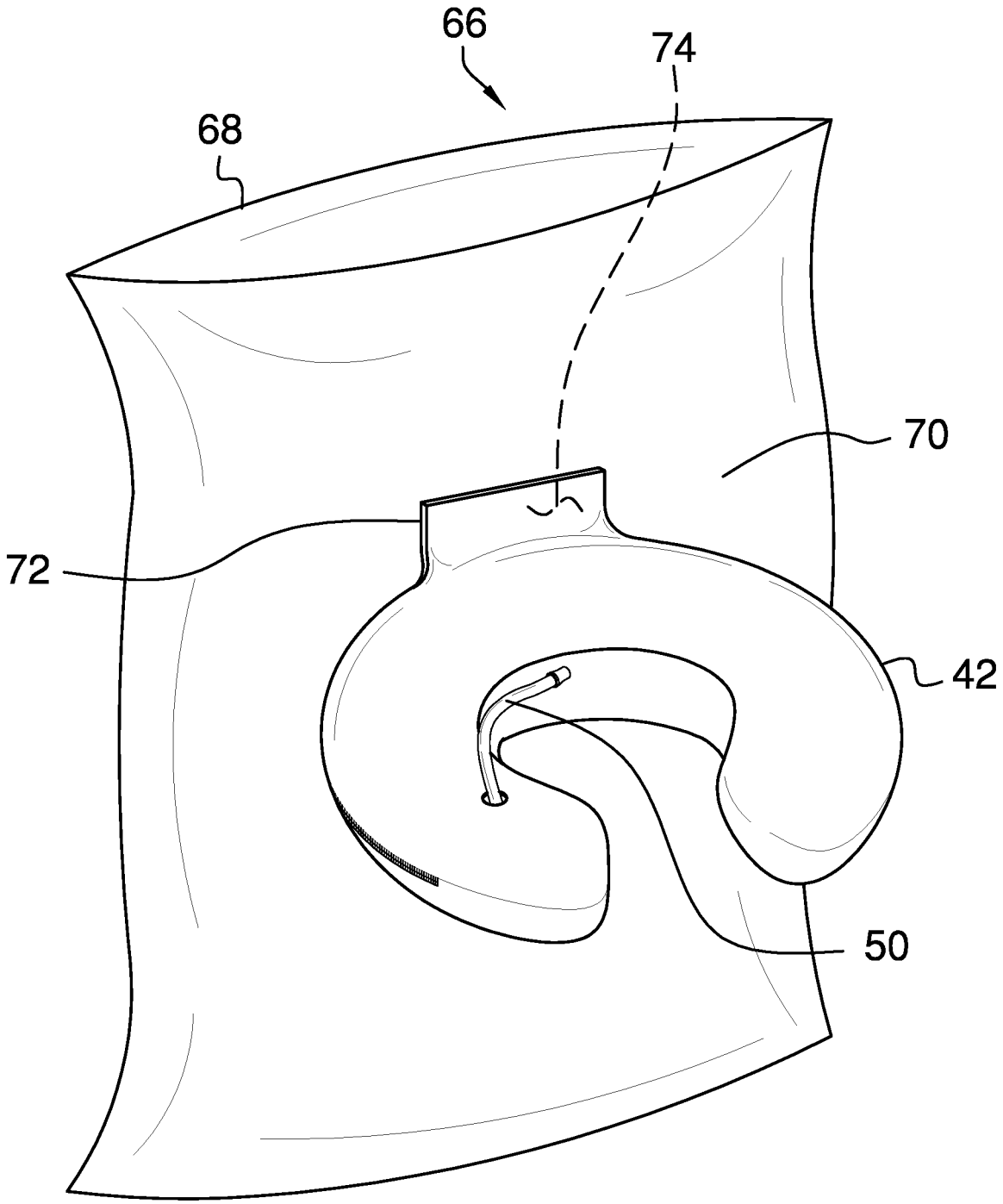
FIG. 7 is a front perspective view of an alternative embodiment of the disclosure.
Figure 8:
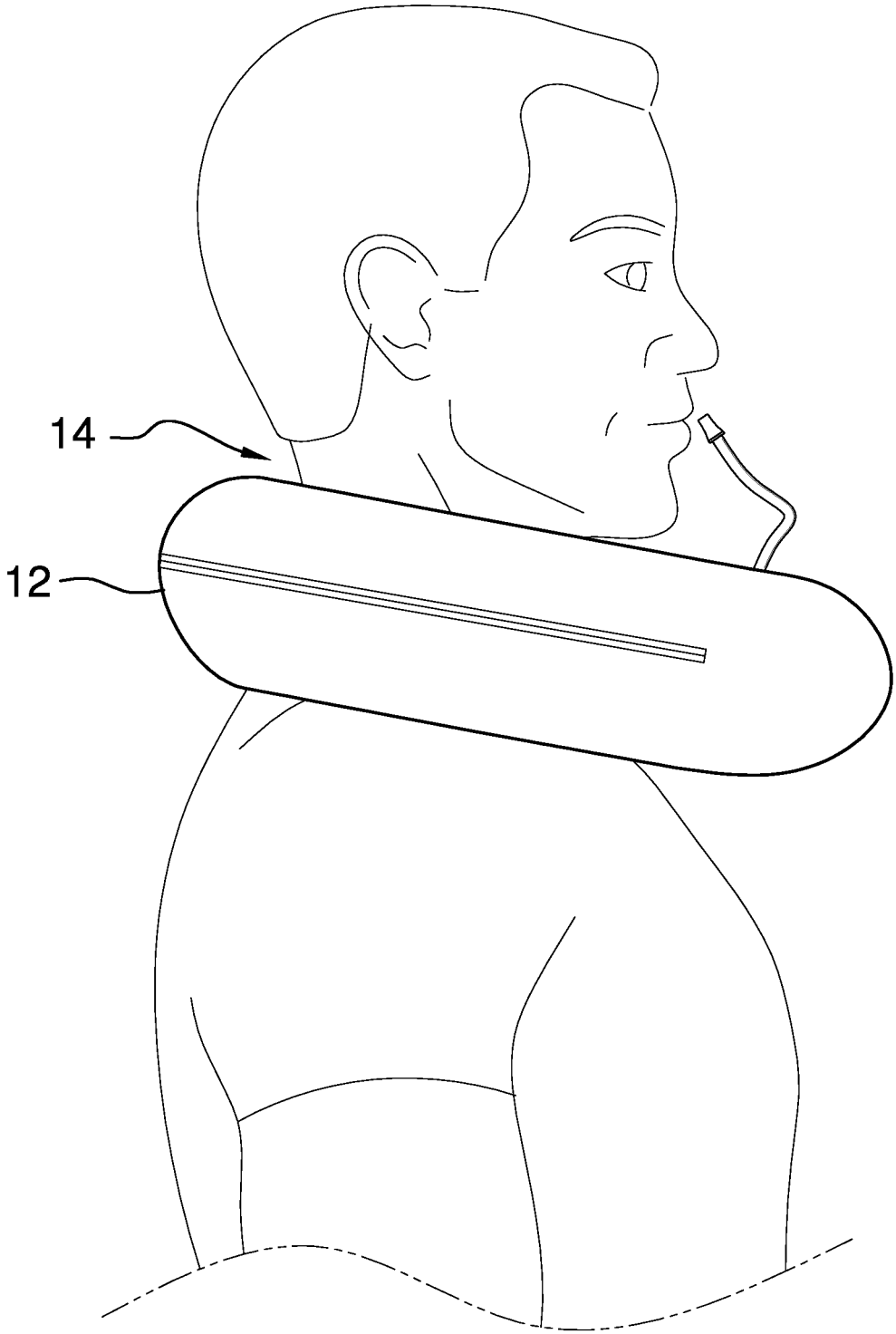
FIG. 8 is a perspective in-use view of an embodiment of the disclosure.

In an alternative embodiment 60 as is most clearly shown in FIG. 6, a pacifier 62 is attached to the upper end 54 of the tube 50 and the pacifier 62 includes a nipple 64 that can be suckled by a child. In an alternative embodiment 66 as is most clearly shown in FIG. 7, a cushion 68 is provided that is comprised of a resiliently compressible material and the cushion 68 has a front side 70. A flap 72 that is integrated into the outer wall 22 of the neck pillow 12 and the flap 72 has a rear surface 74. The rear surface 74 is coupled to the front side 70 of the cushion 68 such that the neck pillow 12 extends along an axis that is oriented perpendicular to a plane defined by the front side 70 of the cushion 68.

In use, the bladder 42 is filled with the liquid beverage 43 and the bladder 42 is inserted into the compartment 16 in the neck pillow 12. Thus, the user can drink the liquid beverage 43 through the tube 50 while the neck pillow 12 is positioned around the user's neck 14. In this way the user can drink the beverage when the user is bed-ridden, for example, or when the user is otherwise limited in their ability to drink a beverage from a conventional beverage container. The neck pillow 12 can be employed in the conventional manner of neck pillow 12*s* when the bladder 42 is not positioned in the compartment 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A neck pillow bladder assembly for dispensing a beverage, said assembly comprising:

a neck pillow being curved into a U-shape wherein said neck pillow is configured to be positioned around a user's neck, said neck pillow having a compartment being integrated into said neck pillow, wherein said neck pillow has a first end, a second end and an outer wall extending therebetween;

a bladder being comprised of a fluid impermeable material wherein said bladder is configured to contain a liquid beverage, said bladder being insertable into said compartment in said neck pillow;

a tube being fluidly attachable to said bladder wherein said tube is configured to receive the fluid beverage, said tube being exposed when said bladder is positioned in said compartment in said neck pillow wherein said tube is configured to be accessible to a user for drinking the liquid beverage from said tube;

a mouthpiece being fluidly coupled to said tube wherein said mouthpiece is configured to be positioned in the user's mouth to facilitate the user to drink the liquid beverage from said mouthpiece;

a cushion being comprised of a resiliently compressible material, said cushion having a front side; and wherein said outer wall of said neck pillow having a flap being integrated into said outer wall, said flap having a rear surface, said rear surface being coupled to said front side of said cushion such that said neck pillow extends along an axis being oriented perpendicular to a plane defined by said front side of said cushion.

2. The assembly according to claim 1, said outer wall being continuously arcuate around an axis extending through said first end and said second end such that said neck pillow has a tubular shape, said outer wall being curved between said first end and said second end having said first end being spaced from said second end, said outer wall having an outwardly facing side and a top side, said outwardly facing side having a cut extending into said compartment, said cut extending substantially between said first end and said second end, said cut having a first bounding edge and a second bounding edge, said top side of said outer wall having a tube opening extending into said compartment, said tube opening being positioned adjacent to said first end.

3. The assembly according to claim 2, wherein said bladder has a primary end and a secondary end, said bladder being elongated between said primary end and said secondary end, said bladder being curved between said primary end and said secondary end such that said bladder conforms to the shape of said neck pillow, said bladder having an outlet extending into an interior of said bladder wherein said outlet is configured to release the liquid beverage from said bladder, said outlet being positioned adjacent to said primary end, said outlet being positioned on an upper side of said bladder.

4. The assembly according to claim 3, wherein said tube has a lower end and an upper end, said tube having a bend thereon being positioned between said lower end and said upper end, said lower end fluidly engaging said outlet in said bladder, said tube extending through said tube opening in said outer wall of said neck pillow when said bladder is inserted into said compartment.

5. The assembly according to claim 4, wherein said upper end being directed toward said second end of said neck pillow when said tube is extended through said tube opening wherein said upper end is configured to be positioned near the user's mouth.

6. The assembly according to claim 4, wherein said mouthpiece is positioned on said upper end of said tube, said mouthpiece being biased into a closed condition wherein said mouthpiece is configured to inhibit the liquid beverage from passing through said mouthpiece, said mouthpiece being urgeable into an open condition wherein said mouthpiece is configured to pass the liquid beverage through said mouthpiece for drinking.

7. A neck pillow bladder assembly for dispensing a beverage, said assembly comprising:

a neck pillow being curved into a U-shape wherein said neck pillow is configured to be positioned around a user's neck, said neck pillow having a compartment being integrated into said neck pillow, said neck pillow having a first end, a second end and an outer wall extending therebetween, said outer wall being continuously arcuate around an axis extending through said first end and said second end such that said neck pillow has a tubular shape, said outer wall being curved between said first end and said second end having said first end being spaced from said second end, said outer wall having an outwardly facing side and a top side, said outwardly facing side having a cut extending into said compartment, said cut extending substantially between said first end and said second end, said cut having a first, bounding edge and a second bounding edge, said top side of said outer wall having a tube opening extending into said compartment, said tube opening being positioned adjacent to said first end;

a closure being coupled to said neck pillow, said closure including a first portion being coextensive with said first bounding edge of said cut, said closure including a second portion being coextensive with said second bounding edge of said cut, said first portion releasably engaging said second portion for opening or closing said cut;

a bladder being comprised of a fluid impermeable material wherein said bladder is configured to contain a liquid beverage, said bladder being insertable into said compartment in said neck pillow, said bladder having a primary end and a secondary end, said bladder being elongated between said primary end and said secondary end, said bladder being curved between said primary end and said secondary end such that said bladder conforms to the shape of said neck pillow, said bladder having an outlet extending into an interior of said bladder wherein said outlet is configured to release the liquid beverage from said bladder, said outlet being positioned adjacent to said primary end, said outlet being positioned on an upper side of said bladder;

a tube being fluidly attachable to said bladder wherein said tube is configured to receive the fluid beverage, said tube being exposed when said bladder is positioned in said compartment in said neck pillow wherein said tube is configured to be accessible to a user for drinking the liquid beverage from said tube, said tube having a lower end and an upper end, said tube having a bend thereon being positioned between said lower end and said upper end, said lower end fluidly engaging said outlet in said bladder, said tube extending through said tube opening in said outer wall of said neck pillow when said bladder is inserted into said compartment, said upper end being directed toward said second end of said neck pillow when said tube is extended through said tube opening wherein said upper end is configured to be positioned near the user's mouth;

a mouthpiece being fluidly coupled to said tube wherein said mouthpiece is configured to be positioned in the user's mouth to facilitate the user to drink the liquid beverage from said mouthpiece, said mouthpiece being positioned on said upper end of said tube, said mouthpiece being biased into a closed condition wherein said mouthpiece is configured to inhibit the liquid beverage from passing through said mouthpiece, said mouthpiece being urgeable into an open condition wherein said mouthpiece is configured to pass the liquid beverage through said mouthpiece for drinking;

a cushion being comprised of a resiliently compressible material, said cushion having a front side; and wherein said outer wall of said neck pillow having a flap being integrated into said outer wall, said flap having a rear surface, said rear surface being coupled to said front side of said cushion such that said neck pillow extends along an axis being oriented perpendicular to a plane defined by said front side of said cushion.

8. The assembly according to claim 7, further comprising a pacifier being attached to said upper end of said tube, said pacifier having a nipple being integrated therein wherein said nipple is configured to be suckled by a child.

* * * * *